US005236143A

United States Patent [19]

Dragon

[11] Patent Number: 5,236,143

[45] Date of Patent: Aug. 17, 1993

[54] INTRAVENOUS TUBING RETRACTOR APPARATUS

[76] Inventor: Bradley P. Dragon, W. 2200 Riverview Dr., Post Falls, Id. 83854

[21] Appl. No.: 780,961

[22] Filed: Oct. 23, 1991

[51] Int. Cl.[5] ..... B65H 75/48

[52] U.S. Cl. ..... 242/107; 242/107.11; 226/187; 604/259

[58] Field of Search ..... 206/397, 408, 409; 226/187; 254/213; 242/107, 107.1, 107.11; 604/259

[56] References Cited

U.S. PATENT DOCUMENTS

| | | | |
|---|---|---|---|
| 700,517 | 5/1902 | Lindsay et al. | 242/107.11 |
| 850,986 | 4/1907 | Weber | 242/107.11 |
| 1,217,941 | 3/1917 | Hobbs | 242/107.11 |
| 2,052,341 | 8/1936 | Douglass | 242/107.11 |
| 2,518,072 | 8/1950 | Rushworth | 242/107.1 |
| 3,853,285 | 12/1974 | Woodring | 242/107.11 |
| 3,982,712 | 9/1976 | Bassett | 206/397 X |
| 3,985,277 | 10/1976 | Wright | 226/187 X |
| 4,177,963 | 12/1979 | Takahashi et al. | 242/107.11 |
| 4,646,987 | 3/1987 | Peterson | 242/107.11 |
| 4,741,439 | 3/1988 | Bizic | 206/397 X |

*Primary Examiner*—Daniel P. Stodola
*Assistant Examiner*—Paul T. Bowen
*Attorney, Agent, or Firm*—Leon Gilden

[57] ABSTRACT

A unitary housing contains a spring-biased return spool, with the spool including a predetermined length of intravenous feed conduit wound thereabout, with the feed conduit directed through a forward and rear wall of the housing and arranged to retract extraneous tubing within the housing. A modification of the invention includes guide roller structure mounted to the forward and rear walls of the housing to guide the tube and direct it therethrough, with the forward wall including a lock mechanism to position the tubing at a predetermined orientation when withdrawn relative to the housing.

1 Claim, 4 Drawing Sheets

INTRAVENOUS TUBING RETRACTOR APPARATUS

BACKGROUND OF THE INVENTION

1. Field of the Invention

The field of invention relates to intravenous feed apparatus, and more particularly pertains to a new and improved intravenous tubing retractor apparatus wherein the same is arranged to maintain intravenous tubing in retracting extraneous tubing relative to an associated patient.

2. Description of the Prior Art

Intravenous feeding of patients is frequently utilized in providing patients with various treatments for associated maladies to provide medication and nutritional infusion typically dissolved within a fluid carrier. Such solutions are directed into a vein or artery of an associated patient by a process known as intravenous feed therapy.

Prior art apparatus associated with therapy is exemplified in U.S. Pat. No. 4,798,590 to O'Leary, et al. wherein a pumping system is utilized in an intravenous feeding situation.

U.S. Pat. No. 4,909,793 to Vining, et al. sets forth a catheter apparatus formed with a retractable stylet for use in intravenous situations.

U.S. Pat. No. 4,941,875 to Brennan sets forth an intravenous feed system for utilizing a plurality of solutions and directing the plurality of solutions at different rates into a patient.

U.S. Pat. No. 4,846,794 to Hertzer sets forth a coiled tubing for intravenous and intra-arterial applications providing a compact feed tube structure.

As such, it may be appreciated that there continues to be a need for a new and improved intravenous tubing retractor apparatus as set forth by the instant invention which addresses both the problems of ease of use as well as effectiveness in construction in providing a retraction of extraneous tubing utilized in intravenous feed situations and in this respect, the present invention substantially fulfills this need.

SUMMARY OF THE INVENTION

In view of the foregoing disadvantages inherent in the known types of intravenous feed apparatus now present in the prior art, the present invention provides an intravenous tubing retractor apparatus wherein the same is arranged to effect retraction of extraneous tubing utilized in intravenous feed scenarios. As such, the general purpose of the present invention, which will be described subsequently in greater detail, is to provide a new and improved intravenous tubing retractor apparatus which has all the advantages of the prior art intravenous feed apparatus and none of the disadvantages.

To attain this, the present invention provides a unitary housing containing a spring-biased return spool, with the spool including a predetermined length of intravenous feed conduit wound thereabout, with the feed conduit directed through a forward and rear wall of the housing and arranged to retract extraneous tubing within the housing. A modification of the invention includes guide roller structure mounted to the forward and rear walls of the housing to guide the tube and direct it therethrough, with the forward wall including a lock mechanism to position the tubing at a predetermined orientation when withdrawn relative to the housing.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved intravenous tubing retractor apparatus which has all the advantages of the prior art intravenous feed apparatus and none of the disadvantages.

It is another object of the present invention to provide a new and improved intravenous tubing retractor apparatus which may be easily and efficiently manufactured and marketed.

It is a further object of the present invention to provide a new and improved intravenous tubing retractor apparatus which is of a durable and reliable construction.

An even further object of the present invention is to provide a new and improved intravenous tubing retractor apparatus which is susceptible of a low cost of manufacture with regard to both materials and labor, and which accordingly is then susceptible of low prices of sale to the consuming public, thereby making such intravenous tubing retractor apparatus economically available to the buying public.

Still yet another object of the present invention is to provide a new and improved intravenous tubing retractor apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figures 1, 2:
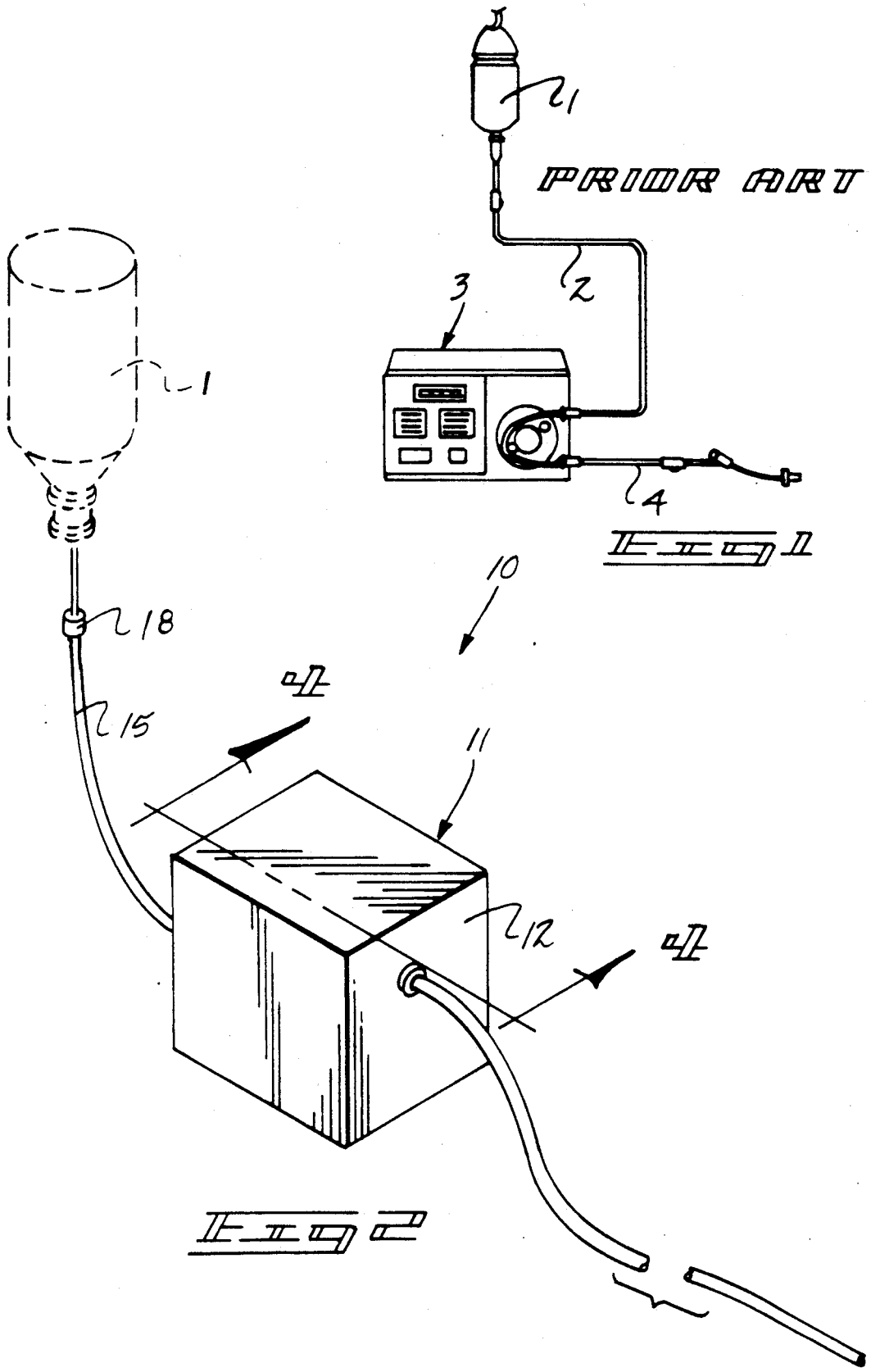
FIG. 1 is an isometric illustration of a prior art intravenous feed apparatus.
FIG. 2 is an isometric illustration of the instant invention.

With reference now to the drawings, and in particular to FIGS. 1 to 8 thereof, a new and improved intravenous tubing retractor apparatus embodying the principles and concepts of the present invention and generally designated by the reference numeral 10 will be described.

FIG. 1 illustrates a prior art intravenous feed apparatus utilizing a supply container 1 cooperative with supply container conduit 2 directed into an intravenous feed pump 3. The feed pump 3 includes an outlet conduit 4 to direct the solution to a patient.

Figures 3, 4:
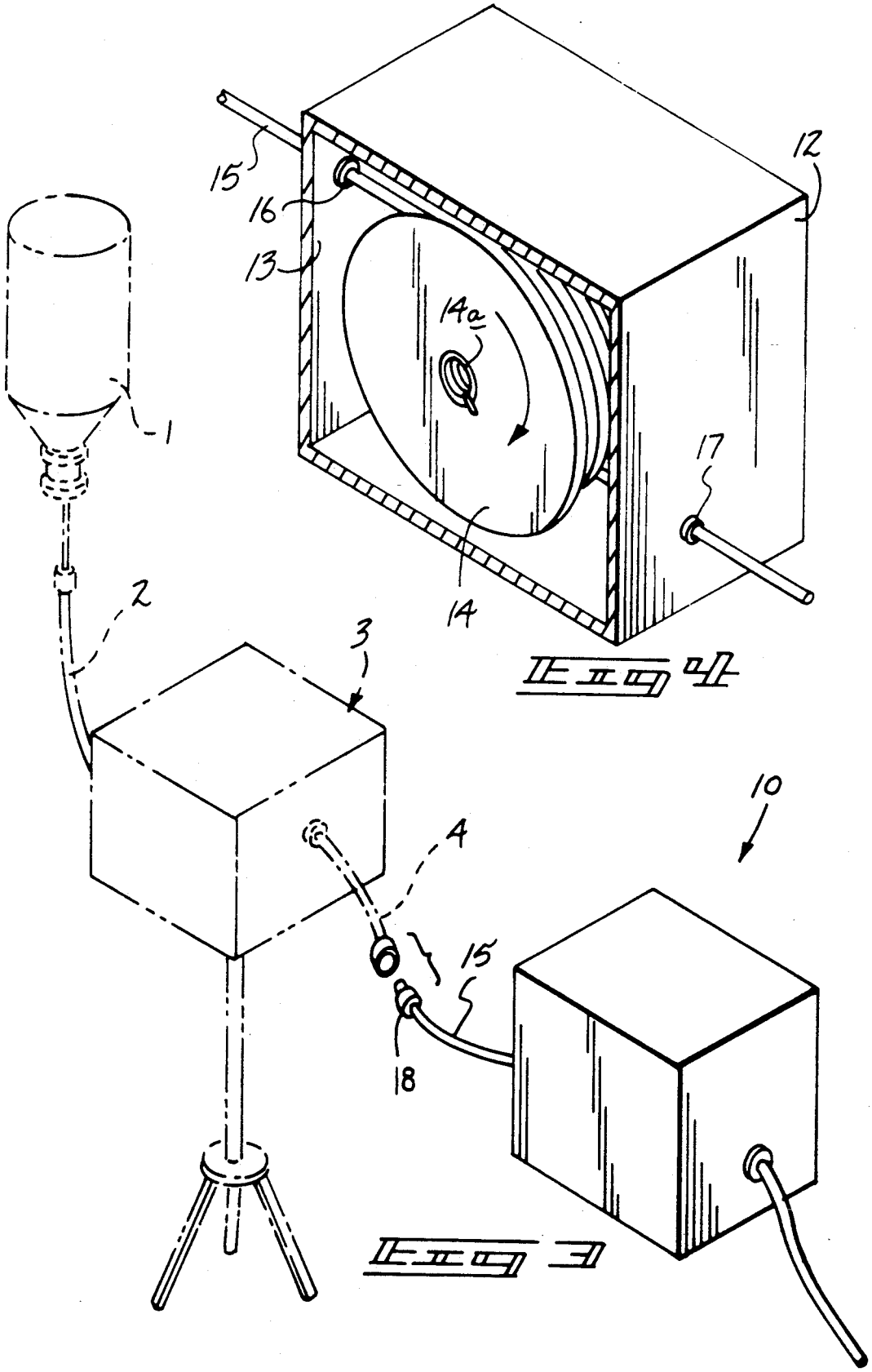
FIG. 3 is an isometric illustration of the invention utilized in association with an intravenous pump.
FIG. 4 is an orthographic view, taken along the lines 4—4 of FIG. 2 in the direction indicated by the arrows.
Figure 5:
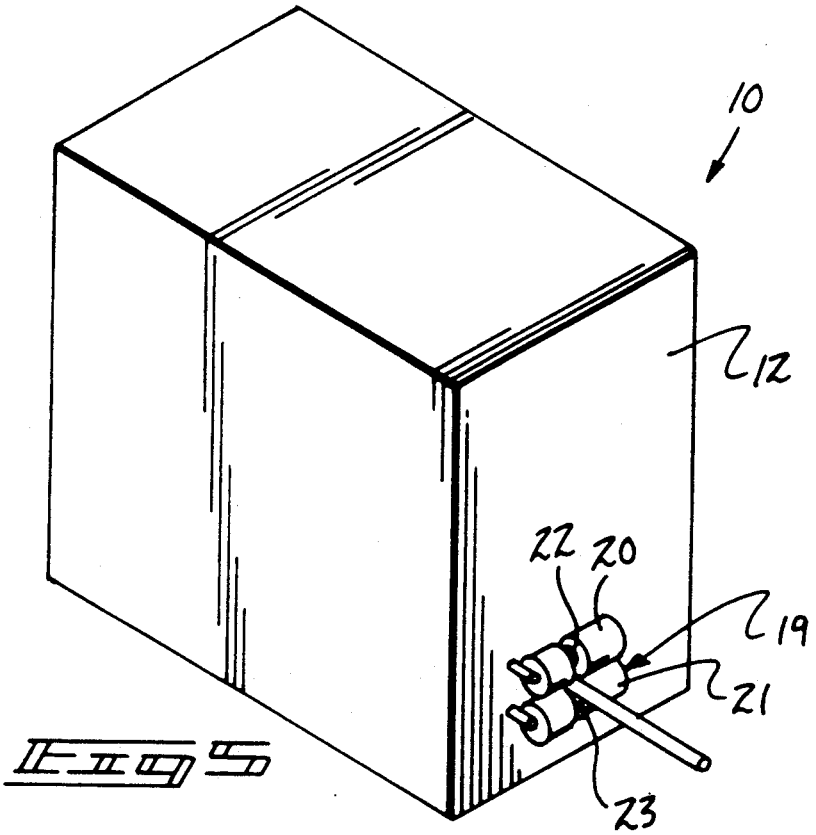
FIG. 5 is an isometric illustration of a modified intravenous conduit guide structure.
Figure 6:
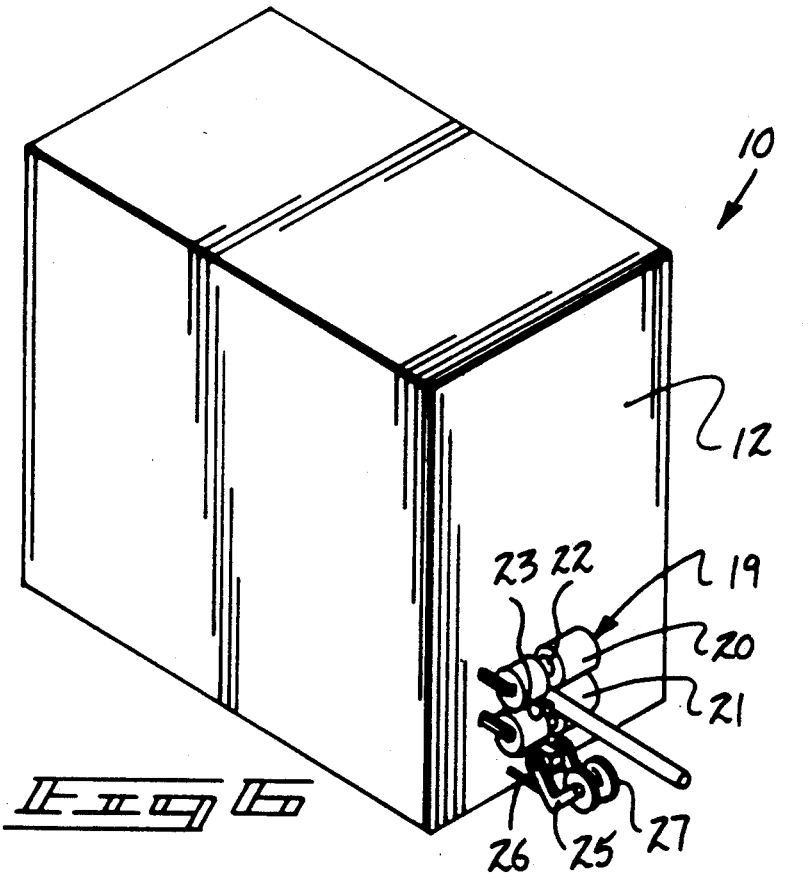
FIG. 6 is an isometric illustration of a further modified intravenous tubing guide structure utilized by the invention.
Figure 7:
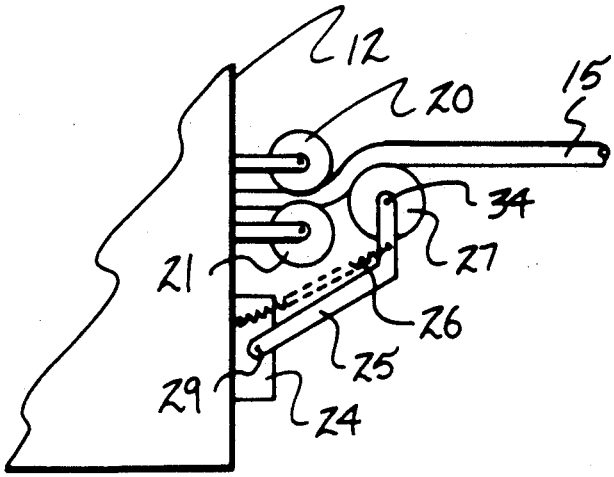
FIG. 7 is an orthographic side view of the guide structure in use, as set forth in FIG. 5.

More specifically, the intravenous tubing retractor apparatus 10 of the instant invention essentially comprises a container housing 11, including a front wall 12 and a rear wall 13 in a spaced relationship mounting a spring-biased retraction spool 14 rotatably between side walls of the housing 11 between the front and rear end walls. The retraction spool 14 includes a central spring-biased hub 14*a* to normally bias the spool in a retracted orientation to retract an elongate intravenous feed conduit 15 interiorly of the housing 11. The rear wall 13 includes a rear wall feed bushing 16, wherein the front wall 12 includes a front wall feed bushing 17. The feed bushings minimize abrasion to the feed conduit directed through the front and rear walls. Tubing connection 18 is typically provided to a rear terminal end of the feed conduit 15 for securement to the outlet conduit 14, as illustrated in FIG. 3, for securement to the pump 3 if such is required, or for securement to the supply container 1, as illustrated in FIG. 2, in a gravity feed situation.

The terminal end of the feed conduit 15 (not shown) is provided with an upper connection as required for association of the feed conduit to a patient.

A guide roller pair 19 is mounted to the front and rear end walls 12 and 13, wherein the guide roller pair 19 mounted to the front end wall 12 is illustrated, but an identical pair is provided to the rear wall, wherein the guide roller pairs 19 include an upper and lower guide roller 20 and 21. The upper guide roller 20 is positioned above an associated feed bushing, wherein a lower guide roller 21 is positioned below an associated feed bushing. Each guide roller of the upper and lower guide rollers 20 and 21 include a respective upper and lower annular feed groove 22 and 23 that are aligned with the associated feed bushing relative to one another to provide guidance to the conduit directed exteriorly of the housing 11.

To provide locking of the feed conduit 15 relative to the housing to prevent inadvertent retraction of the housing about the spring-biased retraction spool 14, a lock mechanism to include a mounting boss 24 is mounted below the upper and lower guide rollers 20 and 21 to the front wall 12. The mounting boss includes at least one "L" shaped pivot arm 25 pivotally mounted to the boss at a lower terminal end of the "L" shaped pivot arm about a first pivot axle 29. The "L" shaped pivot arm 25 includes an upper pivot leg 25*a* and a lower pivot leg 25*b* joined together at a junction. A return spring 26 mounted to the "L" shaped pivot arm 25 and to the mounting boss 24 biases the "L" shaped arm into an orientation biased towards the front end wall 12. A grooved first lock roller 27 is provided rotatably mounted to an upper terminal end of the "L" shaped pivot arm 25 and to the upper pivot leg 25*a* specifically about a first lock roller axle 34 to clamp the conduit 15 in association with the upper guide roller 20.

Figure 8:
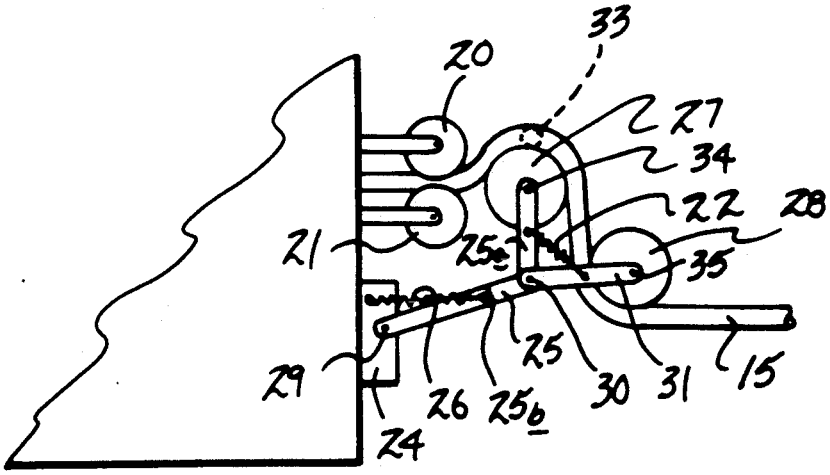
FIG. 8 is an orthographic side view of the modified guide structure and clamping structure, as set forth in FIG. 6.

To provide a looped lower run descending downwardly from the first lock roller 27, as illustrated in FIG. 8, a second lock roller 28 is provided. In this manner, should an air bubble 33 enter the intravenous fluid, the bubble will be trapped as illustrated above the first lock roller 27. The second lock roller 28 is mounted to a second lock roller arm 31 that is pivotally mounted to the junction of the "L" shaped pivot arm 25 about a second pivot axle 30. A second lock roller return spring 32 mounted to the upper pivot leg 25*a* and to the second lock roller arm 31 biases the second lock roller towards the first lock roller and maintains a downwardly directed run of the conduit 15. A second lock roller axle 35 pivotally mounts the second lock roller about a forward terminal end of the second lock roller arm 31 spaced from the second pivot axle 30.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the Unites States is as follows:

1. An intravenous tubing retractor apparatus for use with an intravenous supply container, wherein the apparatus includes a container housing, the container housing including a front end wall spaced from a rear end wall, with the housing including an intravenous feed conduit directed through the housing extending through the front end wall within the housing and through the rear end wall, with the feed conduit defined by a predetermined length, and retraction means mounted within the housing to normally bias the feed conduit within the housing, and the retraction means includes a spring-biased retraction spool rotatably mounted within the housing between the front end wall and the rear end wall, with the retraction spool including a spring-biased hub mounted coaxially of the retraction spool for biasing the retraction spool for directing the feed conduit within the housing, and the front end wall includes a front feed bushing with the feed conduit directed therethrough, and the rear end wall includes a rear wall feed bushing with the feed conduit directed therethrough to minimize abrasion of the feed conduit directed through the housing, and the guide roller pair including an upper guide roller and a lower guide roller, the upper guide roller positioned above the front wall feed bushing, and the lower guide roller positioned below the front wall feed bushing, and the upper guide roller includes an upper guide roller groove, and the lower guide roller includes a lower guide roller groove, wherein the upper guide roller groove and the lower guide roller groove are aligned with the front wall feed bushing and are aligned relative to one another to position the feed conduit therebetween, and the front end wall includes a mounting boss positioned below the lower guide roller, the mounting boss including at least one "L" shaped pivot arm mounted to the mounting boss, the "L" shaped pivot arm pivotally mounted to the mounting boss about a first pivot axle, and the "L" shaped pivot arm including an upper pivot leg and a lower pivot leg joined together at a junction, with the upper pivot leg rotatably mounting a first lock roller rotatably thereabout, with the first lock roller including a first lock roller axle orthogonally directed through the upper pivot leg, and a return spring, the return spring mounted to the junction and to the mounting boss to bias the first lock roller towards the upper guide roller, and a second lock roller arm pivotally mounted to the "L" shaped pivot arm, the second lock roller arm including a return spring mounted between the second lock roller arm and the upper pivot leg of the "L" shaped pivot arm, with the second lock roller arm including a second lock roller mounted to the second lock roller arm about a second lock roller axle, the second lock roller axle orthogonally mounted to the second lock roller arm spaced from the second pivot axle, and the second lock roller return spring biasing the second lock roller towards the first lock roller to provide for an inverted "U" shaped loop within the feed conduit directed through the guide roller pair, the first lock roller, and the second lock roller, with the feed conduit directed between the first lock roller and the second lock roller.

* * * * *